United States Patent [19]

Peele

[11] Patent Number: 4,653,836

[45] Date of Patent: Mar. 31, 1987

[54] SHIELDED ELECTRICAL CONNECTOR

[75] Inventor: Wayne L. Peele, Kernersville, N.C.

[73] Assignee: AMP Incorporated, Harrisburg, Pa.

[21] Appl. No.: 511,422

[22] Filed: Jul. 6, 1983

[51] Int. Cl.[4] ..... H01R 13/648

[52] U.S. Cl. ..... 339/143 R; 339/103 R

[58] Field of Search ..... 339/143 R, 136, 177 R, 339/14 R, 101, 103 M, 103 R, 103 C, 107

[56] References Cited

U.S. PATENT DOCUMENTS

| | | | |
|---|---|---|---|
| 3,732,526 | 5/1973 | Punako | 339/101 |
| 3,889,909 | 6/1975 | Koscik | 339/103 C X |
| 4,236,779 | 12/1980 | Tang | 339/177 R X |
| 4,453,798 | 6/1984 | Asick et al. | 339/143 R |
| 4,544,227 | 10/1985 | Hirose | 339/143 R |

FOREIGN PATENT DOCUMENTS

| | | | |
|---|---|---|---|
| 0040941 | 12/1981 | European Pat. Off. | 339/143 R |
| 832792 | 5/1981 | U.S.S.R. | 339/143 R |

*Primary Examiner*—Eugene F. Desmond

*Attorney, Agent, or Firm*—Robert W. Pitts; Robert W. J. Usher

[57] ABSTRACT

A shield member for an electrical connector comprises a stamped and formed metal shell having a mouth for receiving a mating connector shield comprising a lip having a planar resilient portion extending in the mating direction and a free end formed with a plurality of reversely bent, rigid projections protruding into an envelope defined by the profile of the mouth. Two shield members having interengageable latching means and a rear cable clamping portion of bifurcated hemi-frustoconical shape can be pressed together about a connector terminating a shielded cable with the rigid projections protruding through windows in a housing of the connector into the envelope and the clamping portions gripping between them the cable shield.

12 Claims, 4 Drawing Figures

13
14
31
27
29
20
18
26
17
25
21
24
15
12
29
44
43
45
35
33
39
37
36
39
47
46
48
50
51
38
38
36'
45'
34
37'
39'

SHIELDED ELECTRICAL CONNECTOR

The invention relates to a shield for an electrical connector and to an electrical connector assembly including such shield.

There is an increasing requirement for effective electrical shielding of electrical connectors in view of the increasing complexity and miniaturization of telecommunications and data transmission equipment with consequential risks of cross-talk being significantly increased.

It is important that such shielding can be manufactured and assembled economically by mass production techniques with minimal increases in size of the connector assemblies including the shields.

As the shields are required for existing connector types having standardized interface dimensions, it is desirable that minimal modification be required to the connectors to avoid the costs of radical retooling while retaining the existing interface dimensions.

U.S. Pat. No. 4,337,989 discloses a shield member for an electrical connector comprising a stamped and formed metal shell having a mouth for receiving a mating connector shield the mouth comprising contact parts extending into an envelope defined by the profile of the mouth for engagement with the shield of the mating connector.

However, in the above-mentioned shield member, the contact parts comprise a series of individual resilient fingers forming cantilever beams reversely bent to enter the shell. The requirement for flexure of the beams within the shell to ensure good electrical contact with the mating shield precludes close spacing between the shell and the mating shield. A further disadvantage with the prior shield member is that in order to accommodate the fingers, the shield member extends in the mating direction beyond the profile of a connector enclosed therein which increases significantly the overall length of the assembly.

In the shield member according to the invention, the mouth comprises a lip having a planar resilient portion extending in the mating direction and the contact part comprises a free end of the lip protruding into the envelope. This permits close spacing to be maintained between the shell and the mating shield as the flexure of the lip occurs outside the envelope.

Preferably, the free end of the lip is formed with a plurality of rigid projections protruding into the envelope ensuring a good electrical contact pressure.

Desirably, the projections are reversely bent to extend into the shield member.

The leading edges of the projections provide smooth cam surfaces, facilitating mating.

According to another aspect of the invention, there is provided an electrical connector assembly comprising an insulating housing having an elongate, plug mating face surrounded by a shroud formed with openings on opposite sides of the housing and a rear, wire connecting face, a series of terminals having contact portions and wire connecting portions arranged in rows at the mating face and wire connecting face, respectively, first and second shield members each comprising stamped and formed metal shields having mouths for receiving a mating connector shield, each mouth comprising a lip having a planar resilient portion extending in the mating direction and rear portions adapted to engage the shielding layer of a shielded cable, interengageable means being provided on the shield members to latch them together to enclose the housing with the free edges of the lips protruding through the apertures and the rear portions gripping between them the shielding layer.

The apertures comprise a row of windows extending between a flange on the housing intermediate the contact and wire connecting faces and a ledge extending laterally of the mating face.

Preferably, the housing surface underlying the tongue is rebated to permit the tongue to be concealed behind the ledge.

The rear portions of the shield members may each be of bifurcated hemi-frusto-conical shape. Adjacent edges may diverge towards the free end enhancing the flexibility of each portion. Axially extending apertures may be formed in each portion further to enhance the flexibility.

The above-mentioned features enable the rear portions effectively to engage and grip between them shields of cables various sizes on latching the shields together to maintain electrical contact therewith without a need for additional clamping members required by the prior art.

Other shielded connector structures are shown in U.S. Pat. No. 4,398,780 and U.S. Pat. No. 3,056,942 but the former concerns relatively massive and expensive die cast shields with substantially no resilience and requiring additional cable clamping means while the latter requires additional cable clamping means and is not adapted for mating with a complementary connector.

An example of an electrical connector assembly according to the invention will now be described with reference to the accompanying drawings in which:

FIG. 3 is a cross-sectional view of the assembly mated with a complementary shielded connector; and, FIG. 4 is a fragmentary view of clamping portions of the electrical connector assembly.

Figure 1:
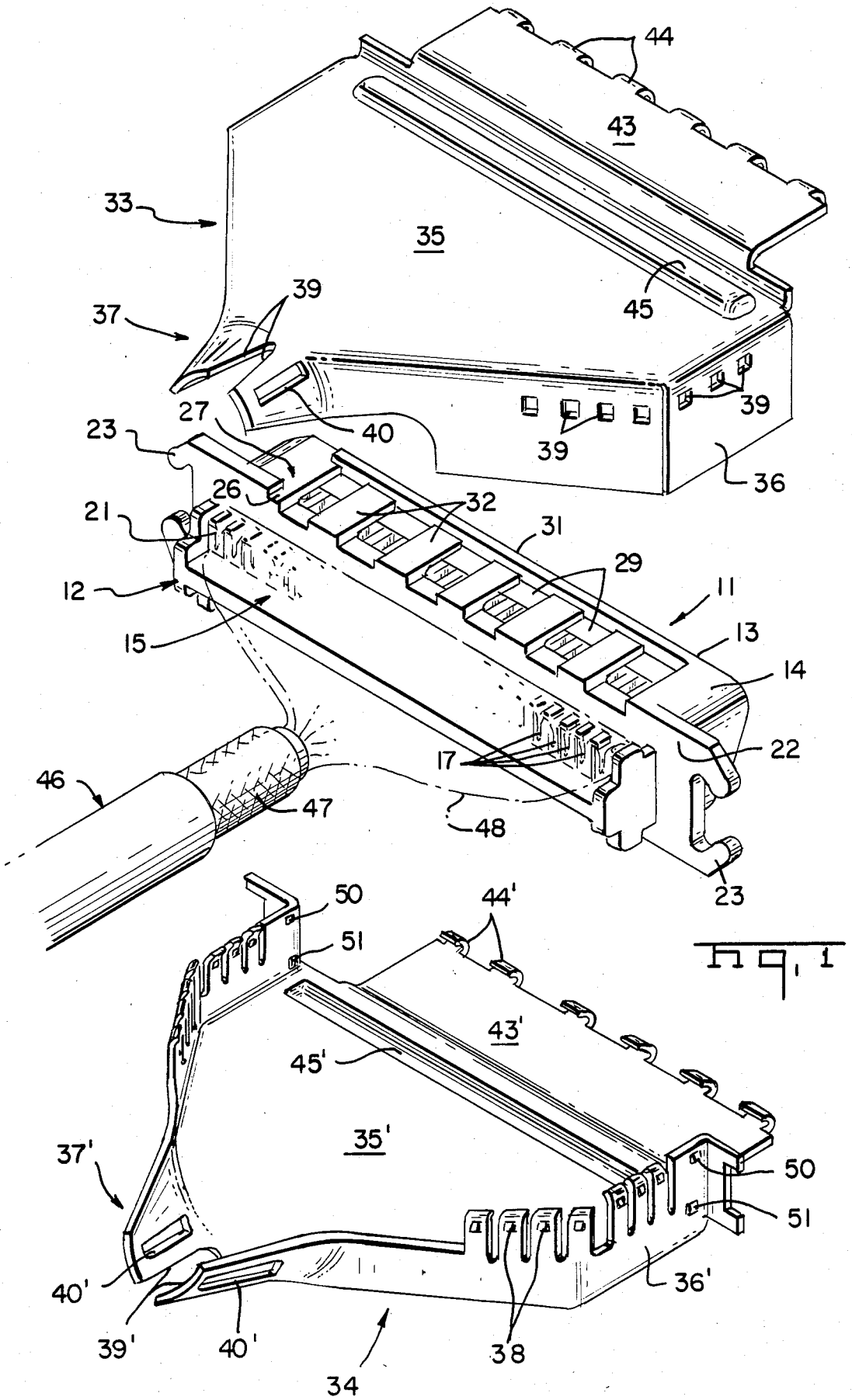
FIG. 1 is an exploded perspective view of the electrical connector assembly with the shield members.
Figure 2:
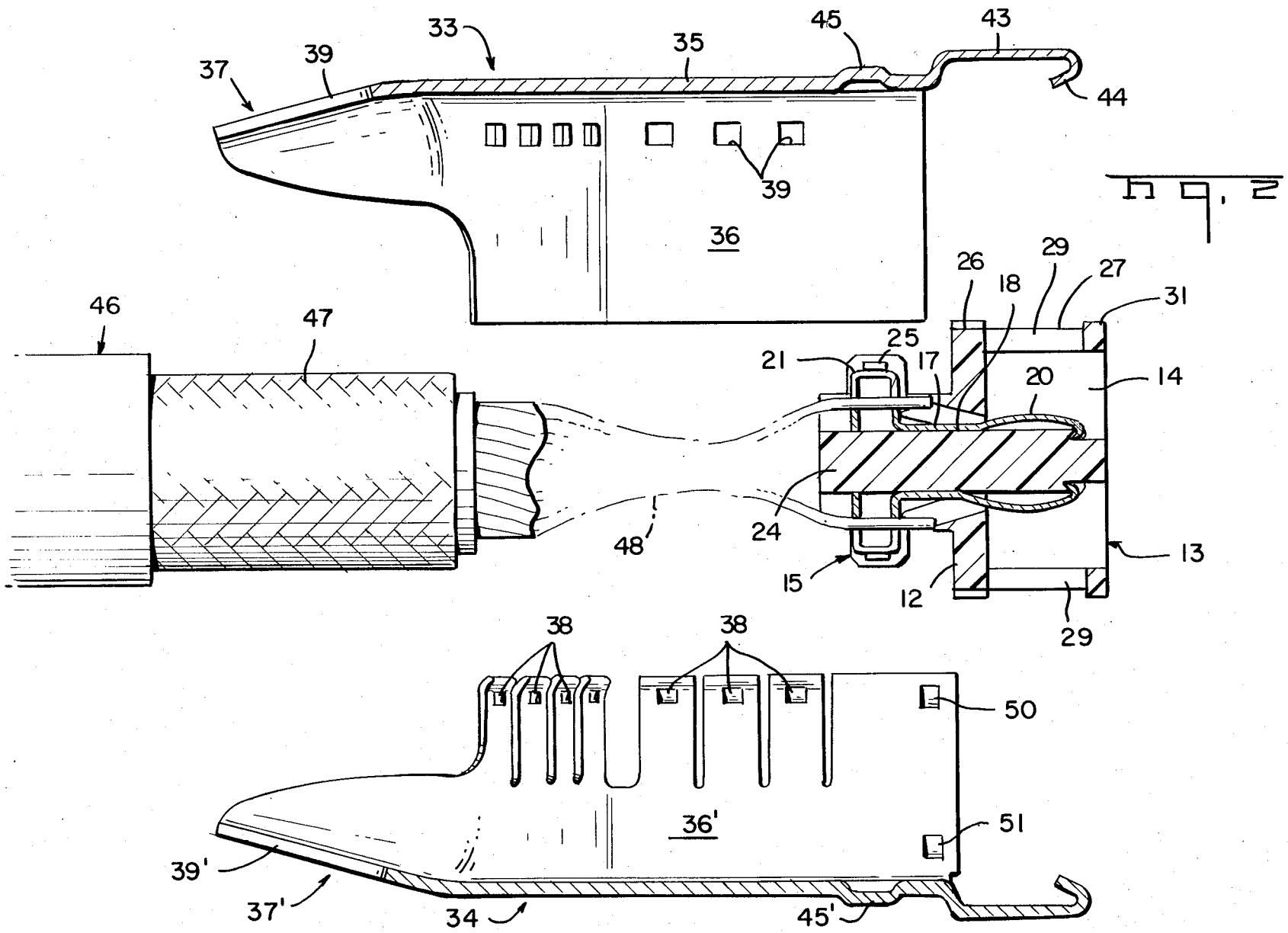
FIG. 2 is a cross-sectional view of the connector and shield members shown in FIG. 1.
Figures 4, 7:
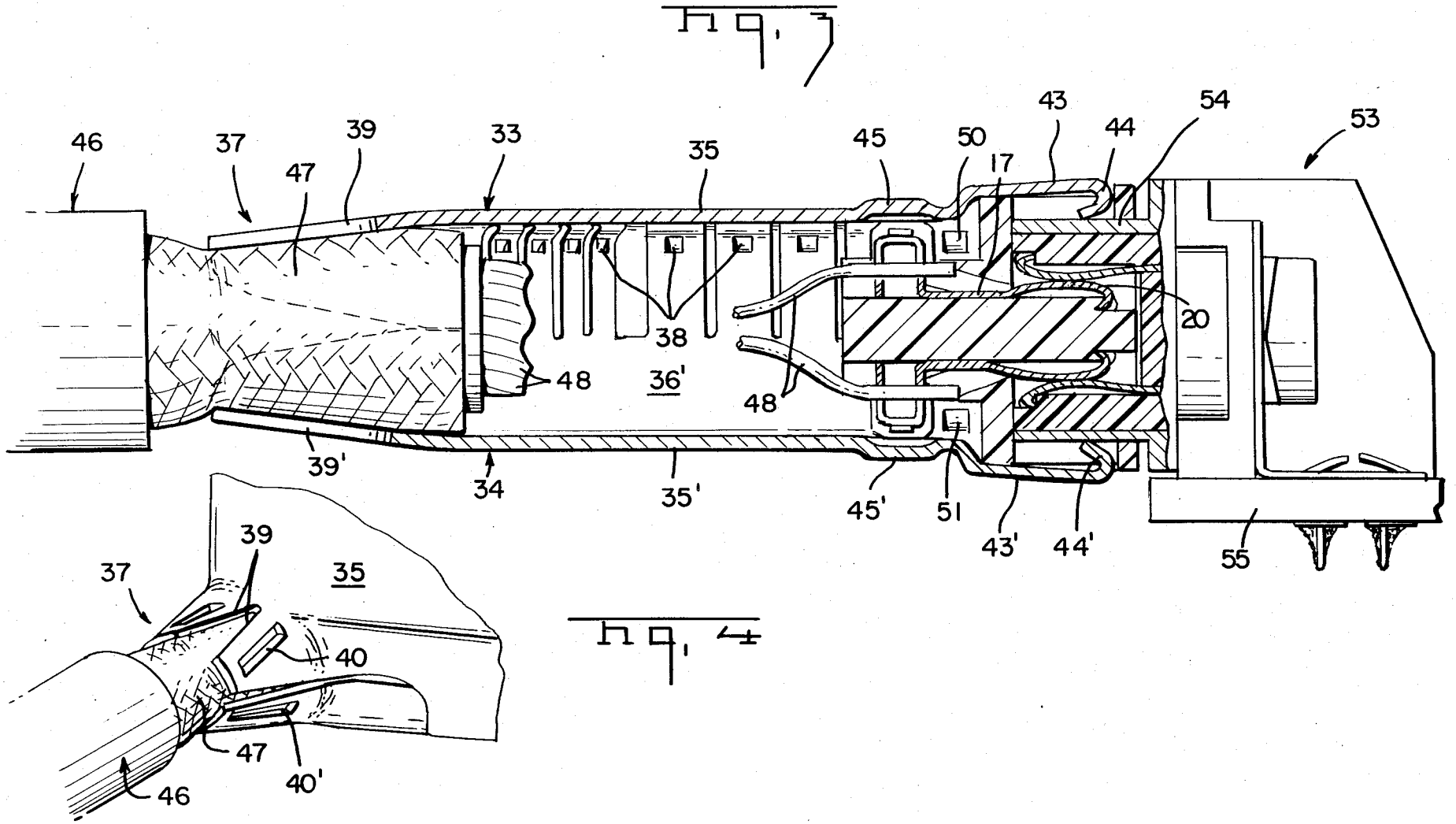

The electrical connector 11 of the assembly is a modified version of that described in U.S. Pat. No. 3,760,335 the disclosure of which is incorporated herein by reference, and comprises an insulating housing 12 having an elongate plug mating face 13 surrounded by a shroud 14 and a rear wire connecting face 15. A series of terminals 17 extend through bores 18 in the housing and have contact portions 20 and wire connecting portions 21 located in two rows at the front and rear faces, respectively. The shroud 14 extends from an intermediate flange 22 having transverse mating ears 23 at respective opposite lateral ends. A terminal support rib 24 extends between the terminal rows from the front to the rear of the housing and a series of barriers 25 extend from opposite sides of the rib so that the wire connecting end of the connector has a generally cruciform cross section. A central portion 26 of the flange and a surface portion 27 of the shroud is rebated on both sides of the connector and the shroud is formed with longitudinal windows 29 extending between the flange and a front end of the shroud which defines a lateral ledge 31 proud of the rebated surface portion 27. A series of strengthening bridges 32 extend between the flange 22 and the ledge 31.

Each shield member 33 or 34 is stamped and formed from a single piece of sheet metal and comprises a planar base wall 35 or 35' from opposite sides of which upstand side walls 36 or 36' in parallel relation adjacent a front of the shield and converging toward the rear to join a cable shield clamping portion 37 or 37'. The side walls of shield member 34 are divided to form latching detents 38 for engagement with apertures 39 formed in the side walls of shield member 33 in a snap action when the shield members are pressed together.

The cable shield clamping portions 37, 37' are each of bifurcated hemi-frusto-conical shape having adjacent edges 39, 39' that diverge towards the rear of the shield. Slots 40, 40' extend longitudinally of the clamping portions to enhance resiliency.

The front mating ends of the shields define a mating connector shield receiving mouth having a planar resilient lip 43 from the free ends of which extend a series of rigid hook form projections 44, 44' respectively. The shield members have transversely extending dished portions 45, 45' for accommodating the barriers 25 and to enhance the rigidity of the shield.

In erecting the assembly, a shielded cable 46 is stripped to expose the braid shield 47 and the individual insulated conductors 48 which are then terminated in the slotted wire receiving portions of the terminals in known manner. The shield member 34 is then pressed onto the terminated cable so that the detents 50 and 51 engage the corners of the barriers 25 as shown in FIG. 3. The shield members 33 and 34 are then pressed together so that the latching detents 38 and apertures 39 snap into engagement with the cable clamping portions gripping the cable and the planar lips 43, 43' overlying the rebated surfaces 27 concealed behind the ledges 31 and with the rigid portions 44, 44' protruding through the windows.

As shown in FIG. 3, the connector assembly can be mated with a right angled header connector 53 having a rigid shield 54 mounted in known manner on a printed circuit board 55. On mating the leading edges of the hooked portions 44, 44' provide cam surfaces causing lips 43, 43' to flex resiliently to provide the contact force with the mating connector shield.

As the lips 43, 43' lie over rebated surfaces 27 of the connector housing, the size of the connector assembly is not substantially increased and the leading edges of the lips 43, 43' are protected by the ledge 31 from damage caused by careless mating.

The cable clamp provides a reliable gripping force over a range of cable sizes obviating the need for an additional clamping member. It should be emphasized that the mating interface dimensions of the standardized connector are maintained with only minor alterations to the configuration of the connector being necessary to accommodate the shield assembly.

I claim:

1. A shield member for an electrical connector comprising a stamped and formed metal shell having a mouth for receiving a mating connector shield, the mouth comprising a contact part extending into an envelope defined by the profile of the mouth, in which the mouth comprises a lip having a planar portion extending in the mating direction, the contact part comprising a free end of the lip protruding into the envelope the lip being relatively more resilient than the contact part, the lip being flexible outside the profile of the mouth and latching means being provided on the shell engageable with complementary latching means on a shell of a similar shield member when the shield members are applied together to enclose the connector.

2. A shield member according to claim 1 in which the free end of the lip is formed with a plurality of rigid projections protruding into the envelope.

3. A shield member according to claim 2 in which the projections are reversely bent to extend into the shield.

4. A shield member according to claim 2 having a rear cable shield clamping portion of bifurcated hemi-frusto-conical shape.

5. A shield member according to claim 4 in which axially extending slots are formed in each shield clamping portion.

6. An electrical connector assembly comprising an insulating housing having an elongate plug mating face surrounded by a shroud formed with openings on opposite sides of the housing and a rear wire connecting face, a series of terminals having contact portions and wire connecting portions arranged in rows at the mating face and wire connecting face, respectively, first and second shield members each comprising stamped and formed metal shells having mouths for receiving a mating connector shield and rear portions adapted to engage the shielding layer of a shielded cable, each mouth comprising a lip having a planar resilient portion extending in the mating direction, interengageable means being provided in the shield members to latch them together to enclose the housing with the free ends of the lips protruding through the openings and the rear portions gripping between them the shielding layer.

7. An electrical connector assembly according to claim 6 in which the openings comprise a row of windows extending between a mounting flange on the housing intermediate the contact and wire connecting faces and a ledge extending laterally of the mating face.

8. An electrical connector assembly according to claim 7 in which the free end of the lip is formed with a plurality of rigid projections protruding into the envelope.

9. An electrical connector assembly according to claim 8 in which the projections are reversely bent to extend into the shell.

10. An electrical connector assembly according to claim 7 in which the housing surface underlying the lip is rebated to permit the lip to be concealed behind a ledge.

11. An electrical connector assembly according to claim 7 in which the rear portions of the shield members are of bifurcated hemi-frusto-conical shape.

12. An electrical connector assembly according to claim 11 in which axially extending slots are formed in each said rear portion further to enhance the flexibility.

* * * * *